US006176293B1

(12) United States Patent
Horst

(10) Patent No.: US 6,176,293 B1
(45) Date of Patent: Jan. 23, 2001

(54) CURTAIN SPREADER AND METHOD OF USING SAME

(76) Inventor: Chester G. Horst, 1251 Louser Rd., Annville, PA (US) 17003

( * ) Notice: Under 35 U.S.C. 154(b), the term of this patent shall be extended for 0 days.

(21) Appl. No.: 09/388,638

(22) Filed: Sep. 2, 1999

(51) Int. Cl.[7] ..... A47H 1/00
(52) U.S. Cl. ..... 160/349.1; 160/349.2; 211/123
(58) Field of Search ..... 160/84.03, 335, 160/334, 340, 342, 330, 350, 349.1, 349.2, 402; 211/123, 203; 248/150, 166

(56) References Cited

U.S. PATENT DOCUMENTS

| | | | | |
|---|---|---|---|---|
| 1,180,143 | * | 4/1916 | Hall | 160/349.2 X |
| 1,697,978 | * | 1/1929 | Hoover | 160/349.2 X |
| 1,776,631 | | 9/1930 | Lee . | |
| 1,954,419 | * | 4/1934 | Lynch et al. | 160/349.2 X |
| 2,303,502 | * | 12/1942 | Rous | 160/349.1 X |
| 2,334,809 | | 11/1943 | Davis | 160/334 |
| 2,364,275 | | 12/1944 | Davis | 160/335 |
| 2,479,778 | | 8/1949 | Pufahl | 211/105.3 |
| 2,595,887 | * | 5/1952 | Ringler | 160/349.2 X |
| 2,765,487 | * | 10/1956 | Foster | 160/349.1 X |
| 3,206,187 | | 9/1965 | Cagley | 286/187 |
| 4,361,914 | * | 12/1982 | Oliver | 211/123 X |
| 5,421,394 | * | 6/1995 | Forrest | 211/123 X |
| 5,809,859 | * | 9/1998 | Johnson | 160/349.2 X |

* cited by examiner

*Primary Examiner*—Bruce A. Lev
(74) *Attorney, Agent, or Firm*—Jacobson & Johnson

(57) ABSTRACT

An adjustable curtain spreader and method of operating same including a telescoping member with a curtain retaining member at each end, each curtain retaining member having the shape of a well so that a curtain can be gathered and contained therein with at least one of the wells having a member thereon which affixes directly to the curtain to maintain the curtain spreader in an aloft position.

8 Claims, 3 Drawing Sheets

CURTAIN SPREADER AND METHOD OF USING SAME

FIELD OF THE INVENTION

This invention relates generally to curtains and more specifically to devices that hold curtains away from windows so that the windows may be tilted inward and cleaned.

BACKGROUND OF THE INVENTION

The chore of cleaning windows is a tedious one, made more difficult by the interference of curtains and the like hanging adjacent to and above the window. The chore is occasionally necessary however, and the problem of moving curtains to a non-interfering position still exists, lest the curtains be soiled or torn by the window sash edge or the cleaner. This is especially true with many of the windows of the present era which have a sash that pivots inward, causing the curtains to come into direct contact with the window sash. A benefit of these types of windows is that they may have both their interior and exterior facings cleaned by a user located within the house.

It is an object of the present invention to spread apart curtains and decorative hangings so that a window may be tilted to facilitate cleaning without the risk of damaging or soiling the curtains.

It is an object of the invention to facilitate windows of varying widths so that one curtain spreader may be used at most window locations.

It is an object of the invention to spread curtains apart without having to refasten permanent curtain fixtures to the walls.

DESCRIPTION OF THE PRIOR ART

U.S. Pat. No. 1,776,631 illustrates a drapery hanger with suspended swingable arms that swing open to expose the window underneath.

U.S. Pat. No. 2,334,809 shows a drapery support with adjustable means to move the drapery without changing the position of the stationary supporting bracket.

U.S. Pat. No. 2,364,275 shows a drapery support constructed in such a way as to allow drapes to be suspended either over the window or along the wall adjacent to window.

U.S. Pat. No. 2,479,778 illustrates an adjustable drapery crane with an adjustable drapery rod affixed thereto.

U.S. Pat. No. 3,206,187 illustrates a swinging check curtain used in mining operations to facilitate air flow control.

SUMMARY OF THE INVENTION

An adjustable curtain spreader and method of operating same which is used during the chore of cleaning windows so that a user might maintain curtains in an out-of-the-way position to prevent damaging or soiling them including a telescoping shaft with a curtain retaining member at each end, each curtain retaining member having the shape of a well so that a curtain can be gathered and contained therein causing the curtains to be spread apart a distance greater than the width of the window itself, with at least one of the wells having a member for engaging the curtain to maintain the curtain spreader in an aloft position.

DESCRIPTION OF THE PREFERRED EMBODIMENT

Figure 1:
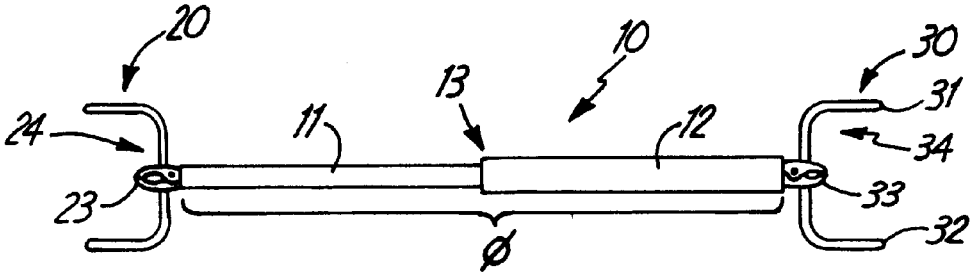
FIG. 1 shows the preferred embodiment of the curtain spreader.

In FIG. 1, reference numeral 10 generally shows the curtain spreader. The curtain spreader 10 comprises a telescoping member 13 with retainer attachments at either end 20 and 30 and two support attachment devices or clasp devices (23 and 33) to secure the curtain spreader in an aloft position. The curtain spreader 10 is adjustable in width to facilitate curtains of differing widths apart. Telescoping member 13 has a left member 11 and a right member 12 that can be slid together or apart a varying distance of Ø so that retainer attachments 20 and 30 will properly engage curtains. The left member 11 and right member 12 are in a frictional relationship with one another so as to prevent collapse of the telescoping member 13 when it engages the weight of the curtains. However, the left member 11 and right member 12 are not engaged so tightly as to prevent a user from adjusting the distance Ø. Curtains will become trapped in the wells 24 and 34 formed by first retainer attachment 20 and second retainer attachment 30. The curtain spreader 10 will be held in position, and the retainer attachments 20 and 30 will securely hold curtains by means of clasp devices 23 and 33 located within retainer attachments 20 and 30.

Figure 2:
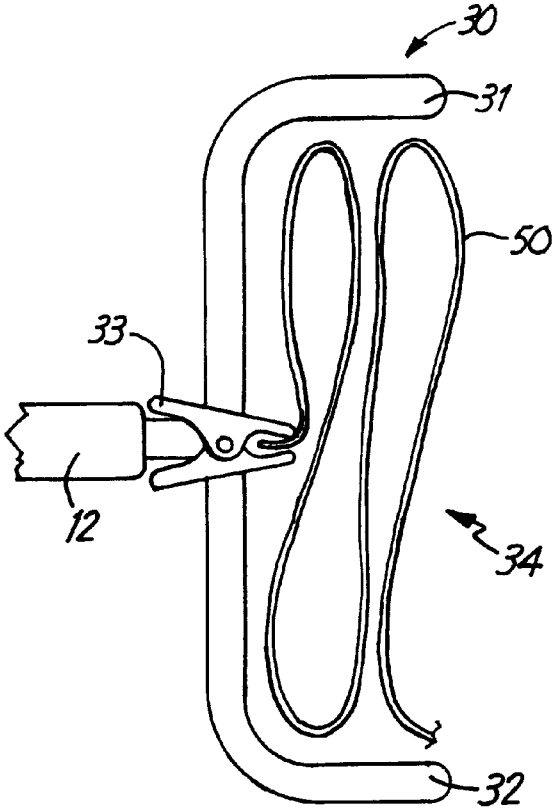
FIG. 2 shows a close up view of a curtain trap located on one end of the curtain spreader.

FIG. 2 shows a retainer attachment 30 in more detail. Retainer attachment 30 is attached to right member 12 and retainer attachment 20 is attached to left member 11. The left retainer attachment 20 and the right retainer attachment 30 are identical in construction in the preferred embodiment so only one will be described herein. Retainer attachment 30 has a first engaging lip 31 and a second engaging lip 32 that together form a well 34 in which curtains 50 are contained. A clasp 33 comprising an alligator type clamp engages with the end of curtain 50 to prevent the curtain spreader, once installed, from sliding down the curtain 50. Note that generally attachment members 20 and 30 have a smooth, tear resistant surface so as to prevent curtain damage during the installation of the curtain spreader.

Figure 3:
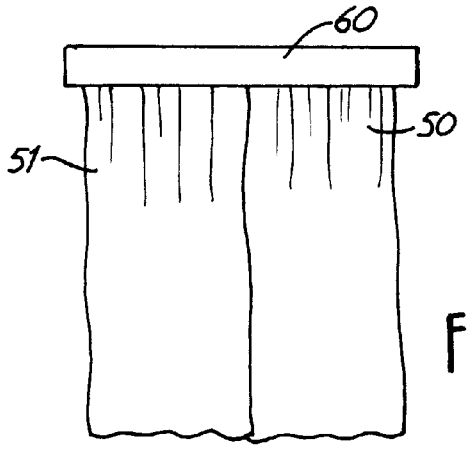
FIG. 3 shows a front view of a standard window with curtains that are in a closed position over the window.

FIG. 3 shows a window (in a covered position) with left drape 51 and right drape 50. A valance 60 is suspended overhead merely to give the drawing a reference point, and it is not as such considered to be a vital component of the present invention. It should further be noted, that although the term curtain is used consistently throughout this application, "curtain" can also be understood to mean drapery, hangings, tapestries, materials and other such things that are utilized to cover windows and other portals.

Figure 4:
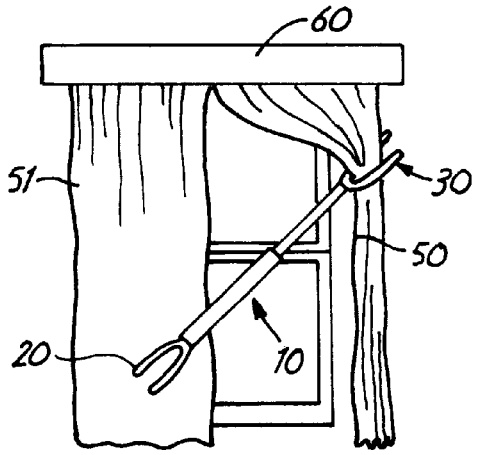
FIG. 4 shows a front view of the curtain spreader being attached to one curtain.

FIG. 4 shows the curtain spreader 10 in the first steps of installation where retainer attachment 30 is placed around an upper portion of the curtain 50 and clasped thereto by clasp 33. Curtain 50 will now remain in the retainer well 34. The left retainer attachment 20 is now in position to be installed.

Figure 5:
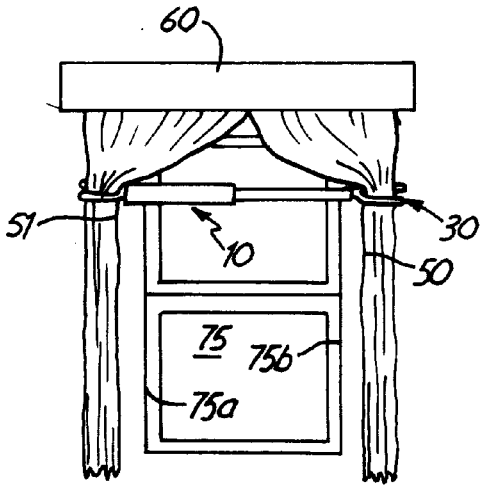
FIG. 5 shows a front view of the curtain spreader holding the curtains apart.

FIG. 5 shows the curtain spreader 10 fully installed. Left retainer attachment 20 has been raised to contain left curtain 51 within left retainer attachment's well 24. Note that the curtains 50 and 51 are now clear of the window edges 75*a* and 75*b*, thus allowing the window to be tilted inward without fear of tearing or soiling the curtains. Generally, the pressure exerted inwardly towards the center of the curtain spreader 10 by the weight of the curtains 50 and 51, coupled with the attachment of clasp 33 to curtain 50, is enough to keep the curtain spreader 10 aloft and in a position to allow the window 75 to be tilted and cleaned. However, for extra security, a second clasp identical to clasp 33 is attached within the well 24 of the left retainer attachment and secured to left curtain 51 to further secure the curtain spreader 10 in an aloft position. This embodiment is especially useful in instances where the curtains are made of particularly light-weight material. It should be noted that curtain spreader 10 is of sufficient stiffness so as to not collapse under the combined inward force of the curtains 50 and 51.

Figure 6:
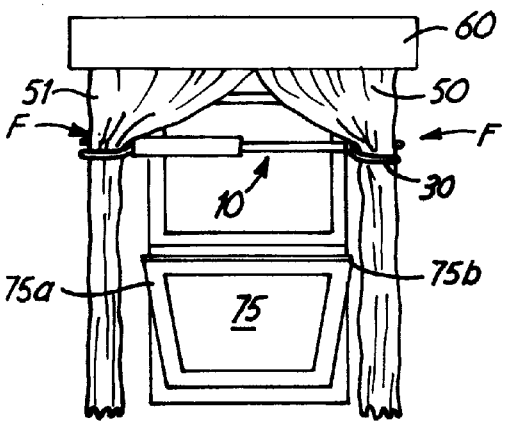
FIG. 6 shows a front view of a tilted window as it has cleared the spread curtains.

FIG. 6 shows the curtain spreader 10 in a secured position and in engagement with the curtains 50 and 51. Window 75 has been tilted inwardly to allow a user to clean the window from the inside of the house. This also prevents the user from needing to remove the screen on a window before cleaning both surfaces of the window. Reference alphanumerical unit F defines the compressive forces placed inwardly upon the curtain spreader 10, which are sufficient enough along with the clasps within wells 24 and 34 to hold the spreader 10 aloft, but not so great as to collapse the spreader.

Figure 7:
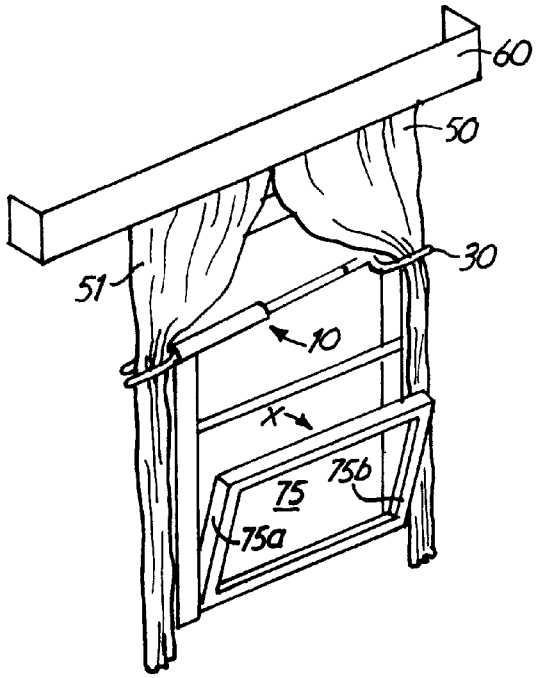
FIG. 7 shows a perspective view of the tilted window clear of the spread curtains.

FIG. 7 shows a perspective view of the curtain spreader 10 holding curtains 50 and 51 apart and window 75 opened inwardly along arc line X to facilitate easy cleaning. In operation, a user adjusts the telescoping curtain spreader 10 to the desired width (a width greater than the width of the window 75), secures the right curtain in the well of the right side of the curtain spreader, clasps the right curtain using the clasp located within the right well, swings up the left side of the curtain spreader and places the left curtain within the left well, clasps the left clasp to the left curtain, whereupon the curtain spreader will be secured. If need be, adjustments can be made by the user to extend or diminish the length of the telescoping curtain spreader 10 if the initial estimate on width needed was incorrect. It should be noted that although the reference positions of "left" and "right" were used in this description, a user could begin attaching the curtain spreader on either the left or the right side initially, and secure the remaining side thereafter.

Figure 8:
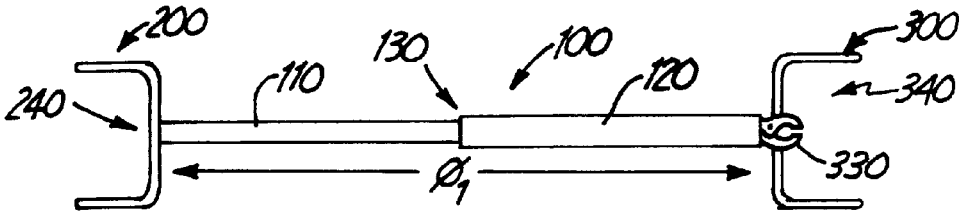
FIG. 8 shows an alternate embodiment of the curtain spreader.

FIG. 8 shows a description of an alternate embodiment of a curtain spreader 100. The curtain spreader 100 comprises a telescoping member 130 with retainer attachments at either end 200 and 300 and one support attachment device 330 to secure the curtain spreader in an aloft position. Telescoping member 130 has a left member 110 and a right member 120 that can be slid together or apart a varying distance of $Ø_1$ so that retainer attachments 200 and 300 will properly engage curtains. The left member 110 and right member 120 are in a frictional relationship with one another so as to prevent collapse of the telescoping member 130 when it engages the weight of the curtains. However, the left member 110 and right member 120 are not engaged so tightly as to prevent a user from adjusting the distance $Ø_1$ of the curtain spreader. Curtains will become trapped in the wells 240 and 340 formed by first retainer attachment 200 and second retainer attachment 300. The curtain spreader 100 will be held in position, and the retainer attachments 200 and 300 will securely hold curtains by means of clasp device 330 located within retainer attachment 300. In operation, a user will gather right curtain within right well 340, attach the clasp 330, swing left member 110 up so that left well 240 engages with left curtain, and allow the force exerted upon the curtain spreader 100 along with the single clasp 330 to hold the curtain spreader aloft, and the curtain spreader apart. It should be noted that a user could install either the left or the right curtain first, as long as the user continued to support the curtain spreader 100 until clasp 330 could be affixed. It should also be noted that the clasp can be on either the right or left side of the embodiment and still fit the description put forth herein.

While a telescoping rod is shown to accommodate differently sized windows, it should be understood that if all of the windows are the same size, the member connecting the retaining members could be fixed in length.

In the preferred embodiment clips are shown to hold the curtain spreader between the two curtains. Other members to hold the curtain spreader aloft could also be used. For example, a frictional surface could be placed on the wells to frictionally engage and hold the curtain spreader in a working condition. Still other members such as hooks or ties could also be used to support the curtain spreader.

What is claimed is:

1. A curtain spreader comprising:

a member having a first end and a second end;

a first attachment forming a retainer for a hanging curtain, said first attachment secured to the first end of said member to retain the hanging curtain in a gathered condition therein;

a second attachment forming a retainer for a second hanging curtain, said second attachment secured to the second end of said member to retain the second hanging curtain in a gathered condition therein with said first and second attachments acting to keep the first and second curtains in a spaced apart condition; and a pair of further members, one member secured within attachment, each further member adapted for positive engagement to one of said hanging curtains, the positively curtain-engaged further member supporting said curtain spreader to provide for independent movement of a sash with respect to said hanging curtains.

2. The curtain spreader of claim 1 wherein said member is a frictionally adjustable telescoping member.

3. The curtain spreader of claim 1 wherein said first attachment forming a retainer and said second attachment forming a retainer are concave in shape.

4. The curtain spreader of clam 1 wherein said further member comprises a clasp device.

5. The curtain spreader of claim 1 wherein said member is of sufficient stiffness so as to not be bendable while supporting curtains.

6. A curtain spreader for gathering curtains away from windows comprising:

a crossbar having a first end and a second end;

a first retainer attached to said crossbar first end to maintain a first curtain in an out of the way position;

a second retainer attached to said crossbar second end to maintain a second curtain in an out of the way position;

first and second spring clips adapted for positively engaging a curtain, said first spring clip attached within said first retainer of said curtain spreader, and said second spring clip attached within said second retainer of said curtain spreader, the positively curtain-engaged spring clips keeping the curtain spreader aloft to thereby enable a sash on a window to be moved independently of the curtain.

7. A method of positioning curtains in an out of the way position so that an underlying window can be easily cleaned or replaced comprising the steps of:

(a) providing a curtain spreader device comprising;

a crossbar having a first end and a second end;

a first retainer attached to said crossbar first end;

a second retainer attached to said crossbar second end; and first and second spring clips adapted for positively engaging a curtain, said first spring clip attached within said first retainer of said curtain spreader and said second spring clip attached within said first retainer of said curtain spreader;

(b) placing a first curtain inside of the first curtain retaining member and securing said first curtain inside a well of said first curtain retaining member utilizing the first spring clip adapted for positively engaging a curtain; and (c) placing a second curtain inside of the second curtain retaining member and securing said second curtain inside a well of said second curtain retaining member utilizing the second spring clip adapted for positively engaging a curtain to thereby spread the first and second curtains apart so that a window located proximate thereto can be opened independently of the first or second curtains.

8. The method of positioning curtains of claims 7 including the step of providing a curtain spreader with a telescoping crossbar and adjusting the width of the telescoping crossbar curtain spreader to position the curtains in a spaced apart condition.

* * * * *